US005988625A

United States Patent [19]

DiRico

[11] Patent Number: 5,988,625

[45] Date of Patent: Nov. 23, 1999

[54] UPRIGHT FEEDER FOR PACKAGING MANUFACTURING SYSTEMS

[75] Inventor: Mark A. DiRico, Quincy, Mass.

[73] Assignee: Hub Folding Box Company, Inc., Mansfield, Mass.

[21] Appl. No.: 09/037,973

[22] Filed: Mar. 9, 1998

[51] Int. Cl.[6] ..... B65H 5/08

[52] U.S. Cl. ..... 271/12; 271/31.1; 271/94; 271/99; 271/104; 271/273

[58] Field of Search ..... 271/11, 12, 10.06, 271/10.07, 31.1, 94, 96, 99, 104, 105, 124, 273, 122, 35; 414/797.5, 797.6, 798.1

[56] References Cited

U.S. PATENT DOCUMENTS

| | | | |
|---|---|---|---|
| 4,050,690 | 9/1977 | Michelsot | 271/11 |
| 4,646,587 | 3/1987 | Hitomori et al. | 271/12 |
| 4,961,566 | 10/1990 | Labombarde | 271/35 |
| 5,464,202 | 11/1995 | Capdeboscq | 271/35 |
| 5,511,772 | 4/1996 | Ganz et al. | 271/12 |

FOREIGN PATENT DOCUMENTS

| | | | |
|---|---|---|---|
| 1285227 | 12/1968 | Germany | 271/35 |
| 406100182 | 4/1994 | Japan | 271/12 |

*Primary Examiner*—H. Grant Skaggs
*Attorney, Agent, or Firm*—Hill & Simpson

[57] ABSTRACT

A vertically oriented feeder for a packaging manufacturing system is provided. The feeder supports a stack of blanks in an upright position and in a confronting relationship with a vertical vacuum belt. The vacuum belt draws a front blank off of the stack and pulls it upward past a gate and between the vacuum belt and a friction belt. After the blank is pulled upward past the gate, a lifting device is activated to push the stack away from the vacuum belt and prevent additional blanks from being drawn upward by the vacuum belt until the lifting device is retracted or de-energized. The lifting device ensures that adequate spacing is provided between adjacent blanks and that the timing of the placement of the blanks on the succeeding flighted belt is sufficiently accurate so that downstream operations may be carried out by automated equipment.

20 Claims, 3 Drawing Sheets

UPRIGHT FEEDER FOR PACKAGING MANUFACTURING SYSTEMS

FIELD OF THE INVENTION

The present invention relates generally to machinery and systems for manufacturing packaging. Still more specifically, the present invention relates generally to feeders for delivering packaging blanks, one at a time, from a stack of blanks to a moving conveyor.

BACKGROUND OF THE INVENTION

Machines for automatically manufacturing packaging are known. Further, machines for manufacturing packaging having more than one component, such as a blank with an opening cut therein over which a clear plastic window is placed, are also known.

In the operation of these manufacturing machines, timing is critical. Specifically, cardboard blanks are delivered to a conveyor by a feeder. The aperture over which a window is attached faces upwards. The conveyor then transports the blank underneath a rotary placer, which is also known in the art. The rotary placer then places a clear plastic window over the aperture of the blank, which is still disposed on the moving conveyor. The operation is carried out continuously. Accordingly, the timing of the delivering of the blank to the conveyor and the movement of the conveyor under the designated point underneath the rotary placer where the clear window is applied to the aperture is crucial. Inaccurate timing in any of the above-referenced steps will result in the window not being accurately placed over the aperture of the blank, i.e. either too high or too low.

At the beginning of the operation, the blank must be delivered to the moving conveyor in a precise and accurate manner. The apparatus designated to deliver the blanks to the conveyor, one at a time, is commonly referred to as a feeder. Currently available feeders include a magazine which accommodates a stack of blanks. The blanks are disposed in a generally horizontal fashion. The lowermost blank of the stack engages a moving conveyor and is drawn off the bottom of the stack.

The above-described design has a number of disadvantages. First, as the stack of blanks gets smaller, the amount of weight imposed on the lowermost blank by the stack changes. Thus, the frictional engagement between the lowermost blank and the belt which draws the lowermost blank from the bottom of the stack varies. This variation in the magnitude of frictional engagement between the lowermost blank and the moving belt causes problems in terms of the accuracy in which the lowermost blank is drawn off the bottom of the stack. For example, when the stack is small, and little weight is applied to the top of the lowermost blank, slippage can occur between the lowermost blank and the moving belt. As a result, the position of the blank on the belt may be shifted which will be translated later down the line. Consequently, the window may not be accurately placed over the aperture in the blank.

Further, if the stack is too high, and the weight imposed on the lowermost blank is too great, slippage again may occur which would change the position of the blank on the belt from the desired position. As a result, the position of the aperture of the blank underneath the rotating placer once the blank arrives at the rotating placer will not be accurate and the window will not be accurately applied to the blank.

Further, another disadvantage involves the belt drawing more than one blank off the bottom of the stack. Specifically, a belt can often grab the lowermost blank and the blank disposed immediately on the top of it which results in two blanks being disposed on the same area of the belt at the same time. This of course can lead to jamming in other mechanisms down the line, the inaccurate placement of the blanks on the belt and the inadvertent production of blanks without a window.

Accordingly, there is need for an improved feeder mechanism for feeding blanks, such as cardboard blanks, and other items of manufacture, one at a time and in an accurate manner to a moving conveyor belt.

SUMMARY OF THE INVENTION

The present invention satisfies the aforenoted needs by providing an upright feeder capable of delivering blanks, one at a time, from a stack of blanks to a moving conveyor. The feeder of the present invention comprises a magazine for accommodating a stack of blanks that are disposed in an upright position. The magazine further comprises a front end for supporting the blanks in a confronting relationship with a moving vacuum belt and a blank lifter device. The vacuum belt travels in an upwardly direction in front of the stack of blanks. The vacuum belt provides suction in a direction away from the stack of blanks and towards the vacuum belt thereby enabling the vacuum belt to engage the blank disposed at the front of the stack and draw the blank upwards as the belt rotates.

The lifter device has at least two positions including an energized position where it has engaged the front blank and has pushed the front blank and the stack of blanks away from the vacuum belt. The energized position is assumed by the lifter device immediately after the vacuum belt has drawn one blank off of the stack and pulled it upwards. Thus, the lifter device prevents the succeeding blank from being drawn off by the vacuum belt prematurely. As a result, engagement of the stack of blanks by the lifter device when it is in its energized position prevents the feeding of two or more blanks at the same time. The lifter device also has a de-energized position where the lifter device is retracted to a longitudinal position with respect to the blanks that is opposite the vacuum belt from the blanks. Thus, in its energized position, the lifter device has moved towards the stack of blanks past the vacuum belt to engage the blanks and thereby prevent the engagement of the front blank by the vacuum belt. In its retracted or de-energized position, the lifter device has been retracted past the vacuum belt so that the vacuum belt is disposed longitudinally between the lifter device and the stack of blanks.

In an embodiment, the feeder further comprises a friction belt disposed above the magazine. The friction belt and the vacuum belt sandwich a blank between the two belts after the vacuum belt has engaged the front blank of the stack and drawn it upwards to the friction belt.

In an embodiment, the friction belt can be raised upwards by a belt lifter mechanism which permits separation of the friction belt and the vacuum belt in the event a blank does become jammed between the two belts. In such an embodiment, instead of disassembling the feeder, friction belt can be simply lifted upward to remove the jammed blank.

In an embodiment, the lifter device is coupled to a servo motor that times the movement of the lifter device between the de-energized and energized positions.

In an embodiment, the movement of the lifter device between the energized and de-energized positions is dependent upon the speed of the conveyor.

In an embodiment, the conveyor comprises a plurality of uniformly spaced flights for receiving a blank between two flights. The movement of the lifer device between the energized and de-energized positions is dependent upon the spacing between two flights.

In an embodiment, the front end of the magazine further comprises a gate disposed in a spaced confronting relationship with the vacuum belt. The front blank passes through the gate and the vacuum belt after the front blank has engaged the vacuum belt and is lifted upward by the vacuum belt. The position of the gate with respect to the vacuum belt, or the spacing between the gate and the vacuum belt, is adjustable.

In an embodiment, the spacing of the gate with respect to the vacuum belt is manually adjustable.

In an embodiment, the present invention provides a method of feeding blanks from a stack of blanks, one at a time, to a combiner and placer machine. The method comprises the steps of providing an upright stack of blanks, placing the stack of blanks so that a front blank is in a confronting relationship with a section of the vacuum belt that is traveling upward, engaging the front blank with the vacuum belt, drawing the front blank upward with the vacuum belt towards a gate, engaging the stack of blanks with a lifter device to prevent a next blank from engaging the vacuum belt until the front blank has been drawn upward and through the gate, and retracting the lifter device to permit the next blank to be engaged by the vacuum belt.

In an embodiment, the method of the present invention further comprises the steps of passing the front blank between the vacuum belt and the gate, sandwiching the front blank between the vacuum belt and a friction belt and depositing the front blank onto a conveyor belt.

It is therefore an advantage of the present invention to provide a feeder mechanism for packaging and manufacturing machinery that feeds package blanks from an upright stack of blanks as opposed to a horizontal stack of blanks.

Another advantage of the present invention is that it provides an improved feeder mechanism for packaging machinery that feeds blanks to a combiner/placer machine with greater accuracy.

Another advantage of the present invention is that it provides an improved feeder for packaging machinery that delivers blanks to a moving conveyor belt with improved timing accuracy.

Another advantage of the present invention is that it provides an improved feeder for packaging machinery that reduces the frequency at which blanks are jammed.

A further advantage of the present invention is that it provides an improved feeder for packaging machinery which delivers blanks to a moving conveyor belt with greater accuracy thereby enabling a rotary placer to more accurately place plastic windows over apertures in the blanks in an automated process.

Other objects and advantages of the present invention will become apparent from reading the following detailed description and appended claims, and upon reference to the accompanying drawings.

BRIEF DESCRIPTION OF THE DRAWINGS

More complete understanding of the present invention, reference should now be made to the embodiment illustrated in greater detail in the accompanying drawing and described below by way of an example of the invention.

In the Drawing.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
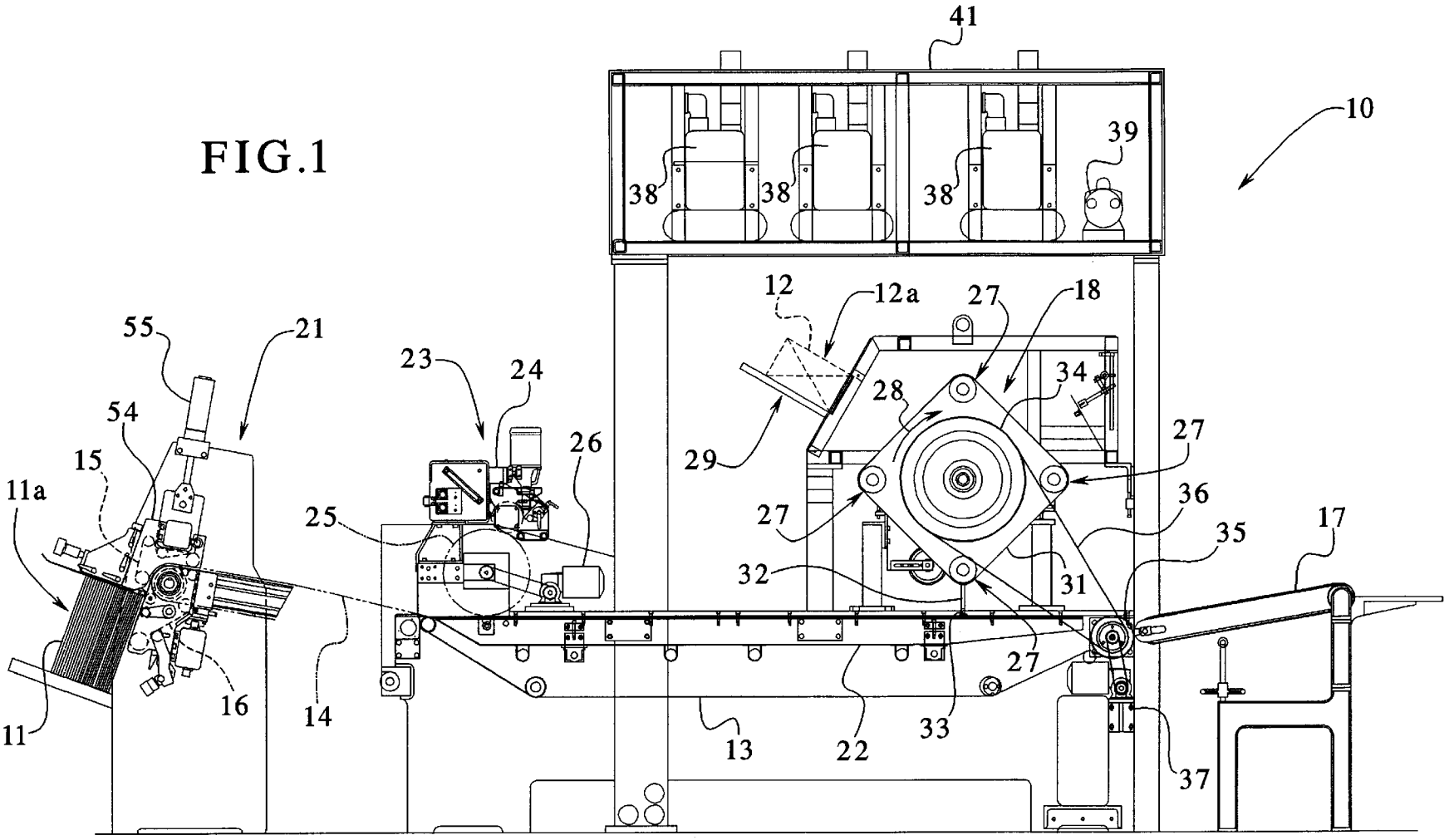
FIG. 1 is a side elevational view of a packaging manufacturing machine incorporating the feeder mechanism of the present invention.

A packaging machine, also referred to as a combiner/placer machine 10 is illustrated in FIG. 1. The machine 10 takes a blank 11 from a stack of blanks 11*a* and accurately places a window 12, taken from a stack of windows 12*a* over an aperture disposed in each blank (not shown), all while belts 13–17 are moving and while a rotary placer 18 is rotating. Accordingly, in order to accurately place one of the windows 12 onto one of the blanks 11, the timing involved in each part of the machine 10 must be accurate. While the present invention is directed primarily to a feeder 21, the remaining elements of the machine 10 will be discussed briefly for purposes of background information. After the feeder 21 deposits a blank 11 onto the flighted conveyor belt 14, the blanks 11 are transported by the belt 14 to the vacuum belt 13 which extends around a vacuum table 22. Immediately after being deposited onto the belt 13, the blanks proceed through a glue station 23. The glue station 23 includes a glue reservoir 24 and a glue drum 25 which is driven by a timing motor 26. The blank 11 is sandwiched between the drum 25 and the vacuum belt 13. The drum 25 then places glue on the blank 11 in a pattern so that the circumference of the aperture which accommodates the window (not shown) is coated with a sufficient amount of glue to adhere the window 12 to the blank 11. Obviously, if the blank 11 is not delivered to the belt 14 and to the belt 13 in a timely manner, the timing of the blank 11 with respect to the drum 25 will not be accurate and the glue will not be applied to the blank 11 in an accurate manner.

Turning to the rotary placer shown at 18, the placer 18 includes four rotating applicators shown at 27 which rotate in the direction of the arrow 28 past the window magazine 29. Each applicator 27 picks up a window 12 from the magazine 29 and places it onto a blank at the lowermost point of rotation of the body 31. At this point, as shown in FIG. 1, each applicator 27 is equipped with an arm 32 that includes a suction device 33 for grasping a window 12 from the magazine 29 and holding the window 12 until it is applied to a blank 11. The body 31 is attached to a wheel 34 which is linked to a harmonic differential 35 by the belt 36. The harmonic differential 35 is also linked to the belt 13 and is rotated by the timing motor 37. Vacuum pumps are shown at 38 and 29 which provide the vacuum for the belt 13 as well as the belt 16, which will be discussed in detail below. The pumps 38, 39 are contained within a sound absorbing enclosure 41.

Figure 2:
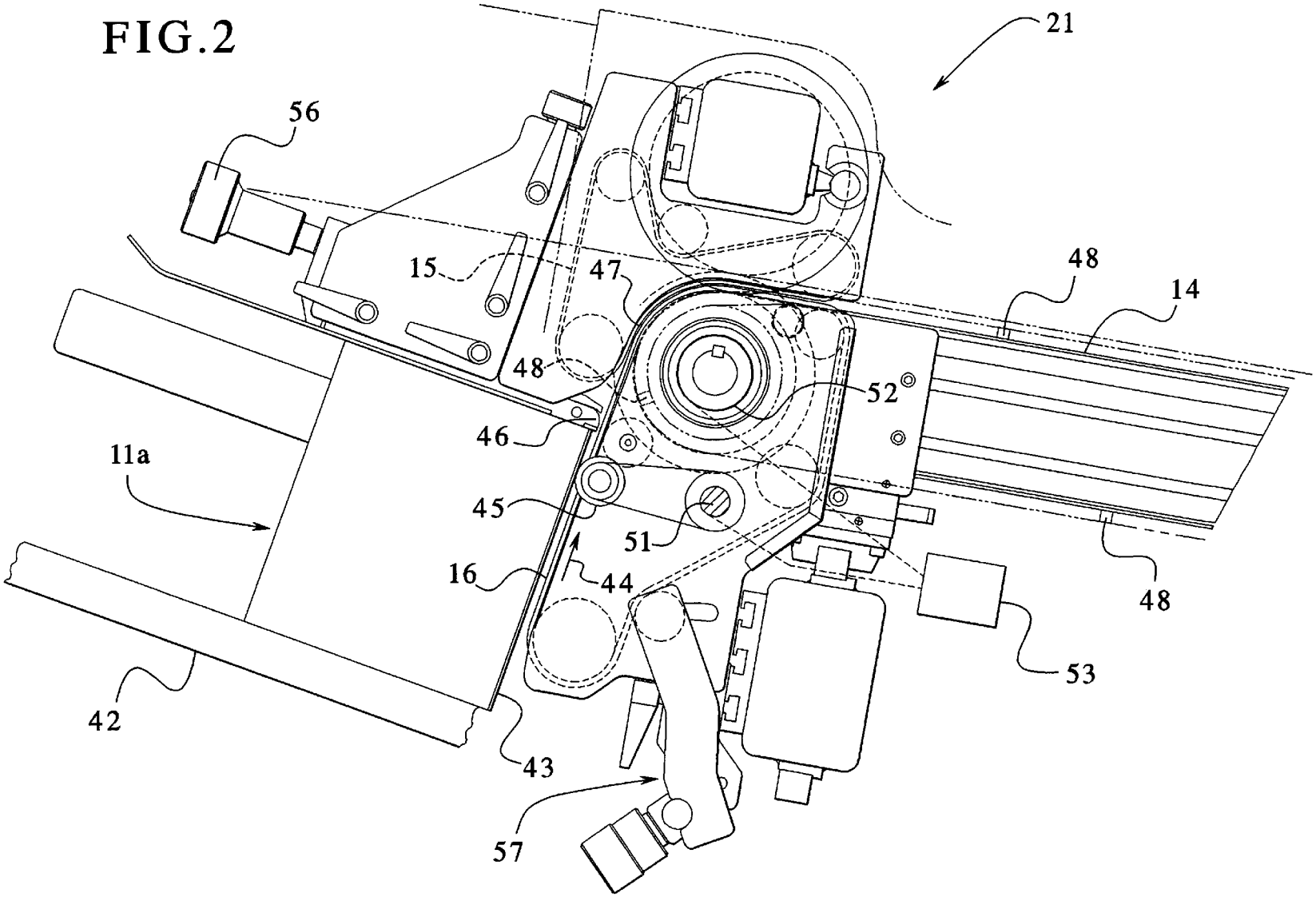
FIG. 2 is a partial side view of the feeder mechanism shown in FIG. 1, particularly illustrating the lifting device in the energized position.
Figure 3:
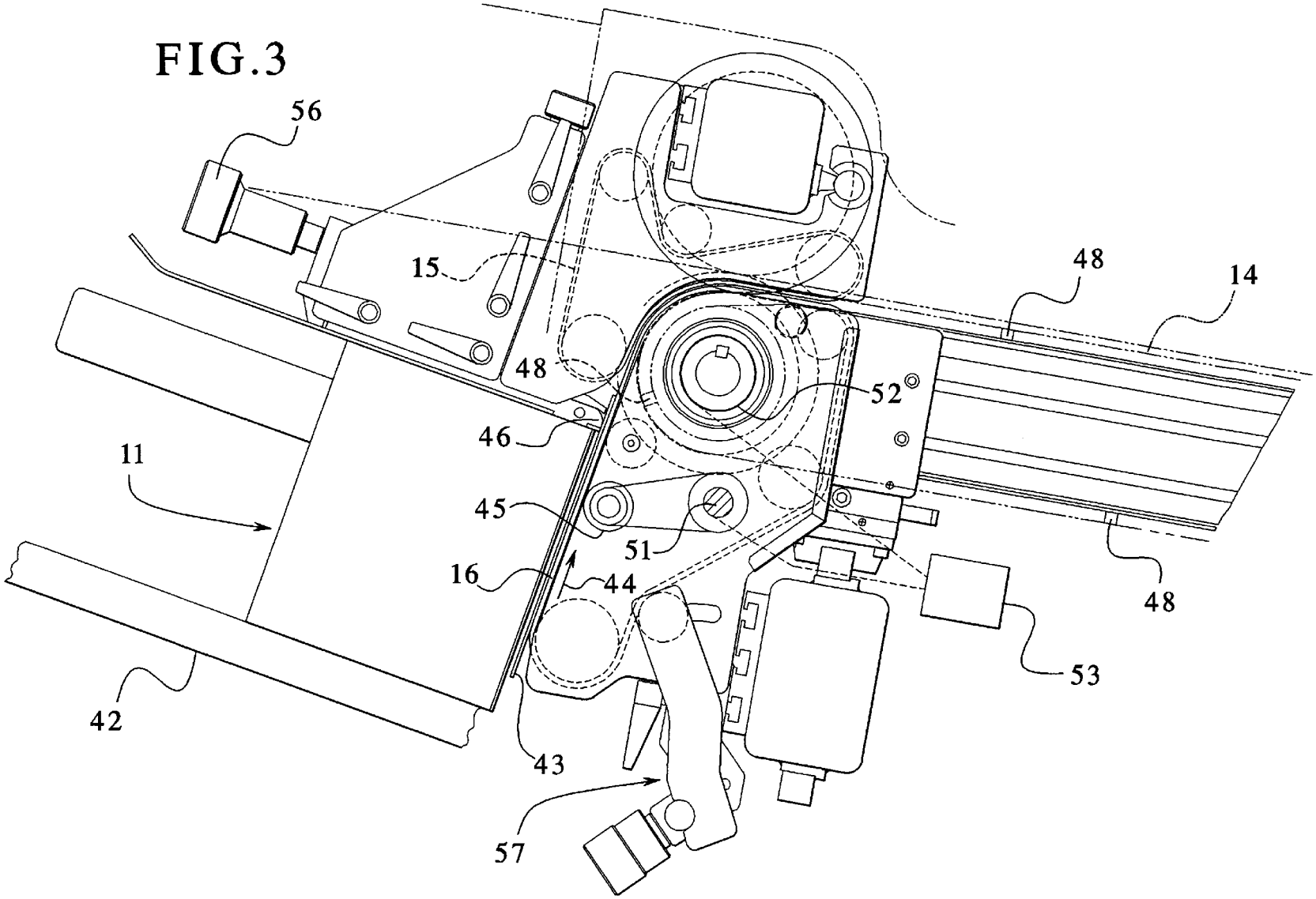
FIG. 3 is another partial side elevational view of the feeder mechanism shown in FIG. 1, particularly illustrating the lifting device in the de-energized position.

Turning now to the feeder 21 and as shown in greater detail in FIGS. 2 and 3, the feeder 21 includes a magazine 42 which supports a stack 11 a of blanks 11. It will be noted from viewing the front blank 43 that the stack 11*a* is an upright stack or a substantially vertically oriented stack as opposed to a horizontal stack whereby the blanks would be laying on top of the magazine 42 in the same manner that they lay on top of a belt. The feeder 21 includes a vacuum belt 16 which is disposed in a confronting relationship with respect to the stack 11*a*. The belt 16 moves upward in front of the stack 11*a*, or in the direction of the arrow 44. As shown in FIG. 2, the vacuum belt 16 is not in an abutting engagement with the front blank 43 due to the position of a lifting device 45. Specifically, the lifting device 45, as shown in FIG. 2, is in an energized or extended position. In the position is shown in FIG. 2, the lifting device 45 has engaged the front blank 43 and pushed the front blank 43 and the stack 11*a* of blanks away from the vacuum belt 16 thereby preventing the front blank 43 from being engaged by the vacuum belt 16 and drawn upward in the direction of the arrow 44. The purpose of the lifting device 45 is to permit a blank that has just been engaged by the vacuum belt 16 and drawn upward past a gate 46 to either be safely sandwiched between the vacuum belt 16 and a friction belt 47 or safely deposited onto the flighted belt 14 between two adjacent flights 48.

Thus, the lifting device 45 prevents more than one blank from being drawn upward by the vacuum belt 16 at a time. As shown in FIG. 3, when the lifting device 45 is in a deactivated or retracted position, the front blank 43 is drawn forward wherein it engages the vacuum belt 16. The suction provided by the vacuum belt 16 enables the vacuum belt 16 to draw the front blank upwards in the direction of the arrow 44 and between belt 16 and gate 46. Shortly after the front blank 43 gets out of the way of the lifting device 45, the lifting device 45 will extend towards the stack 11 from its retracted or de-energized position as shown in FIG. 3 to its extended or energized position shown in FIG. 2. In this manner, only one blank 43 can be drawn upward by the vacuum belt 16 at a time and the spacing between succeeding blanks will be maintained.

The lifter device 45 is mounted onto a shaft 51. The shaft 51 of the lifter device 45 and the drive wheel 52 of the flighted belt 14 are both coupled to a servo motor and drive timing mechanism shown at 53. The timing of the action of the lifter device 45 is based upon the speed of the flighted belt 14 and the spacing between adjacent flights 48.

Returning to FIG. 1, but still referring to the feeder 21, the friction belt 15 is coupled to a housing 54. The housing 54 is also connected to a lifting mechanism 55. In the event a blank becomes jammed between the vacuum belt 16 and the friction belt 15, the feeder 21 need not be substantially disassembled. Instead, the lifting mechanism 55, which can be a hydraulic or gear-type lifting mechanism, can be activated so as to raise the friction belt 15 upward away from the vacuum belt 16. Then, access is provided between the belts 15, 16 to permit removal of the jammed blank or blanks.

Returning to FIGS. 2 and 3, it will be apparent to those skilled in the art that the spacing between the gate 46 and the vacuum belt 16 will depend largely upon the type of blanks 11 being utilized. Accordingly, it is important that the spacing between the gate 46 and the vacuum belt 16 be adjustable. To that end, a manual adjustment knob 56 is provided which can be used to move the gate 46 closer to the belt 16 or farther away from the belt 16. The tensions of the belts 15, 16 are adjustable by means apparent to those skilled in the art, such as the tension adjustment mechanism shown at 57. In a preferred embodiment, the servo motor and drive timing control 53 is mounted to a side frame (not shown) of the feeder 21.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A feeder for delivering blanks, one at a time, from a stack of blanks to a conveyor, the stack of blanks including a front blank, the feeder comprising:

a magazine for accommodating the stack blanks in an upright position, the magazine comprising a front end for supporting the blanks in a confronting relationship with a vacuum belt and a blank lifter device, the vacuum belt traveling in an upwardly direction in front of the stack of blanks, the vacuum belt providing suction in a direction away from the stack of blanks and towards the vacuum belt, the lifter device having an energized position where it engages the front blank and pushes the front blank and the stack of blanks away from the vacuum belt, the lifter device having a de-energized position where the lifter device is retracted to a longitudinal position opposite the vacuum belt from the blanks.

2. The feeder of claim 1 further comprising a friction belt disposed above the magazine, the friction belt and vacuum belt sandwiching the front blank between the friction and vacuum belts after the vacuum belt has engaged the front blank and drawn the front blank upwards to the friction belt.

3. The feeder of claim 2 wherein the friction belt is connected to a housing, the housing is connected to a belt lifter mechanism for lifting the friction belt upward and away from the vacuum belt in the event a blank becomes jammed between the friction belt and the vacuum belt.

4. The feeder of claim 1 wherein the lifter device is coupled to a servo motor, the servo motor being in communication with a controller that times the actuation of the servo motor and the movement of the lifter device between the de-energized and energized positions.

5. The feeder of claim 1 wherein the movement of the lifter device between the energized and de-energized positions is dependent upon the speed of the conveyor.

6. The feeder of claim 1 wherein the conveyor includes a plurality of uniformly spaced flights for receiving a blank between two flights, the movement of the lifter device between the energized and de-energized positions being dependent upon the spacing between the flights.

7. The feeder of claim 1 wherein the front end of the magazine further comprises a gate disposed in a spaced confronting relationship with the vacuum belt, the front blank passing between the gate and the vacuum belt after the front blank engages the vacuum belt and is lifted by the vacuum belt, a position of the gate with respect to the vacuum belt being adjustable.

8. The feeder of claim 7 wherein the position of the gate with respect to the vacuum belt is manually adjustable.

9. A method of feeding blanks, from a stack of blanks, one at a time, to a combiner and placer machine, the method comprising the following steps:

providing an upright stack of blanks, placing the stack of blanks so that a front blank is in a confronting relationship with a section of a vacuum belt that is traveling upward, engaging the front blank with the vacuum belt, drawing the front blank upward with the vacuum belt towards a gate, engaging the stack of blanks with a lifter device to prevent a next blank from engaging the vacuum belt until the front blank has been drawn upward and through the gate, retracting the lifter device.

10. The method of claim 9 further comprising the following steps after the drawing step:

passing the front blank between the vacuum belt and the gate, sandwiching the front blank between the vacuum belt and a friction belt, and depositing the front blank onto a conveyor belt.

11. The method of claim 10 further comprising the step of timing movements of the lifter device based upon the speed of the conveyor belt.

12. The method of claim 10 wherein the conveyor belt includes a plurality of uniformly spaced flights for receiving a blank between two flights, the method further comprising the step of timing movements of the lifter device based up on the spacing between the flights.

13. The method of claim 9 wherein the friction belt is connected to a housing, the housing is connected to a belt lifter mechanism for lifting the friction belt upward and away from the vacuum belt in the event a blank becomes jammed between the friction belt and the vacuum belt.

14. The method of claim 9 further comprising the step of timing movements of the lifter device with a servo motor.

15. The method of claim 9 further comprising the step of adjusting a position of the gate with respect to the vacuum belt.

16. A vertical feeder for delivering blanks, one at a time, from a stack of blanks, to a flighted conveyor of an automatic combiner and placer machine, the stack of blanks including a front blank, the feeder comprising:

a magazine for accommodating the stack blanks in an upright position, the magazine comprising a front end for supporting the blanks in a confronting relationship with a vacuum belt and a blank lifter device, the vacuum belt traveling in an upwardly direction in front of the stack of blanks, the vacuum belt having pressure drop across a portion of the belt passing in front of the stack of blanks so that a front blank can be suctioned against said portion of the vacuum belt, the lifter device pivotally moving between an energized position where it engages the front blank and pushes the front blank and the stack of blanks away from the vacuum belt and a de-energized position where the lifter device is retracted to a longitudinal position opposite the vacuum belt from the stack of blanks, the magazine further comprising a gate disposed in a spaced confronting relationship with the vacuum belt, the front blank passing between the gate and the vacuum belt after the front blank engages the vacuum belt and is lifted by the vacuum belt, the spacing of the gate with respect to the vacuum belt being adjustable, the feeder further comprising a friction belt disposed above the magazine, the feeder belt and vacuum belt sandwiching the front blank between the friction and vacuum belts after the vacuum belt has engaged the front blank and drawn the front blank upward to the friction belt, the friction belt being connected to a housing, the housing being connected to a belt lifter mechanism for lifting the friction belt upward and away from the vacuum belt in the event a blank becomes jammed between the friction belt and the vacuum belt.

17. The feeder of claim 16 wherein the lifter device is coupled to a servo motor that times the movement of the lifter device between the de-energized and energized positions.

18. The feeder of claim 16 wherein the movement of the lifter device between the energized and de-energized positions is dependent upon the speed of the conveyor.

19. The feeder of claim 16 wherein the conveyor includes a plurality of uniformly spaced flights for receiving a blank between two flights, the movement of the lifter device between the energized and de-energized positions being dependent upon the spacing between the flights.

20. A method of feeding blanks, from a stack of blanks, one at a time to a combiner and placer machine, the method comprising the following steps:

providing an upright stack of blanks, placing the stack of blanks so that a front blank is in a confronting relationship with a section of a vacuum belt that is traveling upward, engaging the front blank with the vacuum belt, drawing the front blank upward with the vacuum belt towards a gate, engaging the stack of blanks with a lifter device to prevent a next blank from engaging the vacuum belt until the front blank has been drawn upward and through the gate, passing the front blank between the gate and the vacuum belt, retracting the lifter device, sandwiching the front blank between the vacuum belt and a friction belt, depositing the front blank onto a conveyor belt, timing the steps of engaging the stack of blanks with the lifter device and retracting the lifter device based upon the speed of the conveyor belt.

* * * * *